US006024039A

United States Patent [19]

Mack et al.

[11] Patent Number: 6,024,039

[45] Date of Patent: Feb. 15, 2000

[54] CAUSEWAY MOORING APPARATUS

[75] Inventors: Kit Leroy Mack, Camarillo, Calif.; Alexandre Viana, Sterling, Va.

[73] Assignee: The United States of America as represented by the Secretary of the Navy, Washington, D.C.

[21] Appl. No.: 09/307,015

[22] Filed: May 7, 1999

[51] Int. Cl.[7] ..... B63B 21/04

[52] U.S. Cl. ..... 114/218; 114/266

[58] Field of Search ..... 114/266, 267, 114/263, 218, 230.1; 405/218–221

[56] References Cited

U.S. PATENT DOCUMENTS

| | | | |
|---|---|---|---|
| 3,073,274 | 1/1963 | Lamb | 114/267 |
| 3,091,203 | 5/1963 | Usab | 114/266 |
| 4,260,293 | 4/1981 | Peterson | 114/267 |

*Primary Examiner*—Ed Swinehart
*Attorney, Agent, or Firm*—David Kalmbaugh

[57] ABSTRACT

A causeway mooring apparatus adapted for use with a causeway having a plurality of spaced apart pontoons. The causeway mooring apparatus fits within a gap between adjacent pontoons of the causeway and includes a cleat which is used to secure tow or mooring lines to the causeway. The causeway mooring apparatus is secured to the adjacent pontoons and a pair of L-shaped stringers by a plurality of threaded bolts which also allow for the removal of the causeway mooring apparatus from the causeway. The foundation for the causeway mooring apparatus is an L-shaped tubular support structure. A pair of side stiffener plates are attached to the L-shaped tubular support structure. The side stiffener plates have a cleat mounting plate affixed to their top edge with the cleat mounting plate supporting the cleat. The side stiffener plates transfer applied loads from the cleat through the L-shaped tubular support structure of the mooring apparatus to the pair of L-shaped stringers.

15 Claims, 5 Drawing Sheets

CAUSEWAY MOORING APPARATUS

BACKGROUND OF THE INVENTION

1. Field of the Invention

This invention relates generally to mooring apparatus. More particularly, the present invention relates to a causeway mooring apparatus for use in securing mooring and tow loads of up 200,000 pounds.

2. Description of the Prior Art

Presently, causeway mooring apparatus for use with a causeway in an ocean going or open sea environment are severely limited in their load capacity. For example, an attachment means commonly used by the military to secure tow lines to a causeway is designated as the PH-10 mooring device. The PH-10 mooring device is rated to 135,000 pounds.

For a commonly used tow line fabricated from two wraps of four inch double braided nylon rope, the load capabilities of the P-10 mooring device are inadequate. Since the four inch double braided nylon rope has a breaking strength of 59,000 pounds, there is a need for mooring device which is substantially stronger than the P-10 and, in particular, there is a need for a mooring device which will accommodate mooring and tow loads approximating 240,000 pounds.

SUMMARY OF THE INVENTION

The present invention comprises a causeway mooring apparatus adapted for use with a causeway having a plurality of spaced apart pontoons.

The causeway mooring apparatus fits within a gap between adjacent pontoons of the causeway and includes a cleat which is used to secure tow or mooring lines to the causeway. The causeway mooring apparatus is secured to the adjacent pontoons and a pair of L-shaped stringers by a plurality of threaded bolts which also allow for the removal of the causeway mooring apparatus from the causeway.

The foundation for the causeway mooring apparatus is an L-shaped tubular support structure. A pair of side stiffener plates are attached to the L-shaped tubular support structure. The side stiffener plates have a cleat mounting plate affixed to their top edge with the cleat mounting plate supporting the cleat. The side stiffener plates transfer applied loads from the cleat through the L-shaped tubular support structure of the mooring apparatus to the pair of L-shaped stringers.

It is an object of the present invention to provide a mooring force transfer apparatus interposed within adjacent pontoons of a causeway which operates in an open sea environment.

It is another object of the present invention to provide a mooring force transfer apparatus which will provide a rigid structure such that structural failure of the mooring line securing fitting is substantially eliminated.

It is yet another object of the present invention to provide a reliable yet inexpensive mooring transfer apparatus which has a long service life.

The above, other objects, advantages and novel features of the present invention will become more apparent from the following detailed description of the invention when considered in conjunction with the accompanying drawings, where like numerals refer to like components in so far as it is possible and practical to do so.

DETAILED DESCRIPTION OF THE PREFERRED EMBODIMENT

Figure 1:
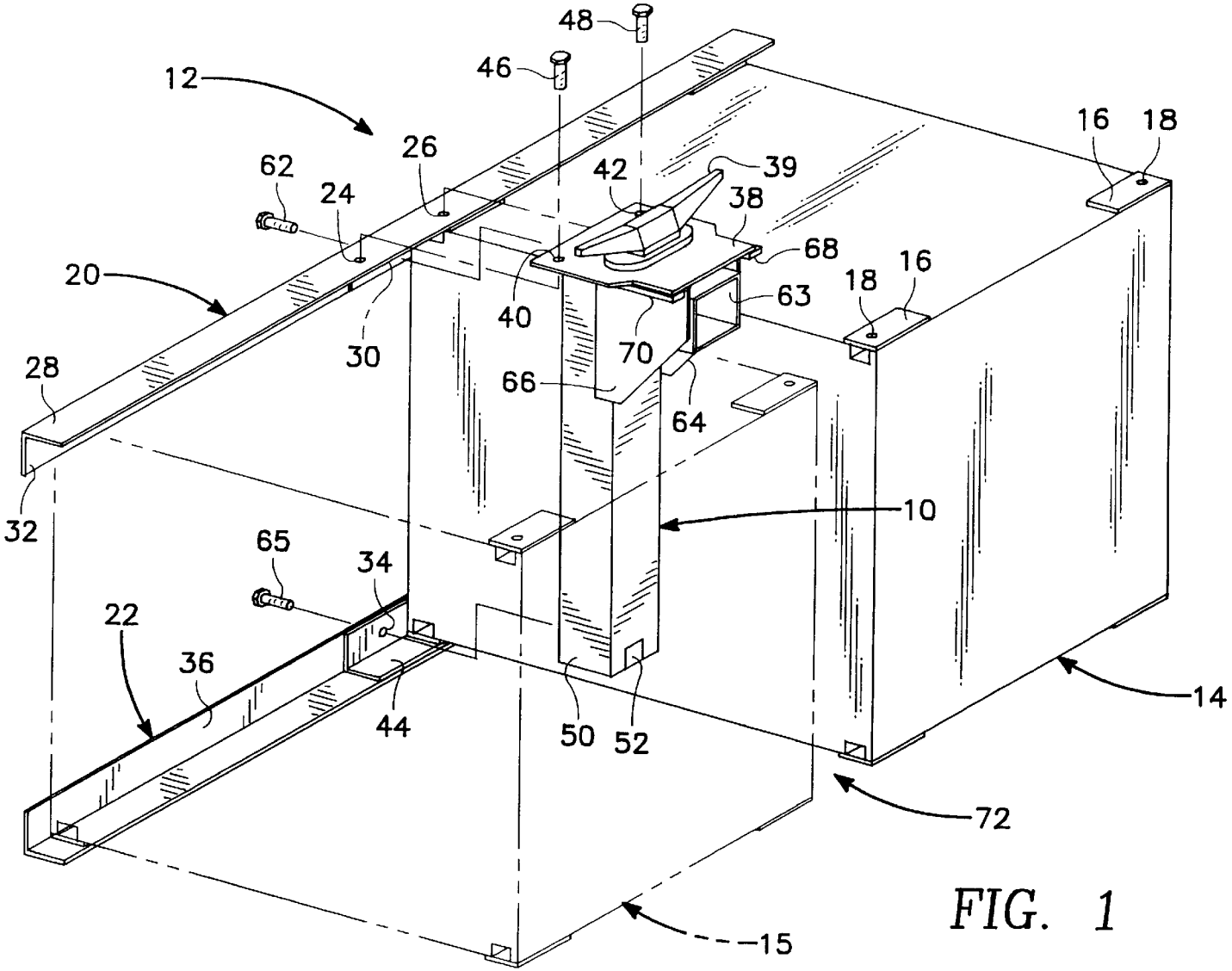
FIG. 1 is an exploded view illustrating the causeway mooring apparatus comprising the present invention being used with a pair of pontoons of a causeway.
Figure 2:
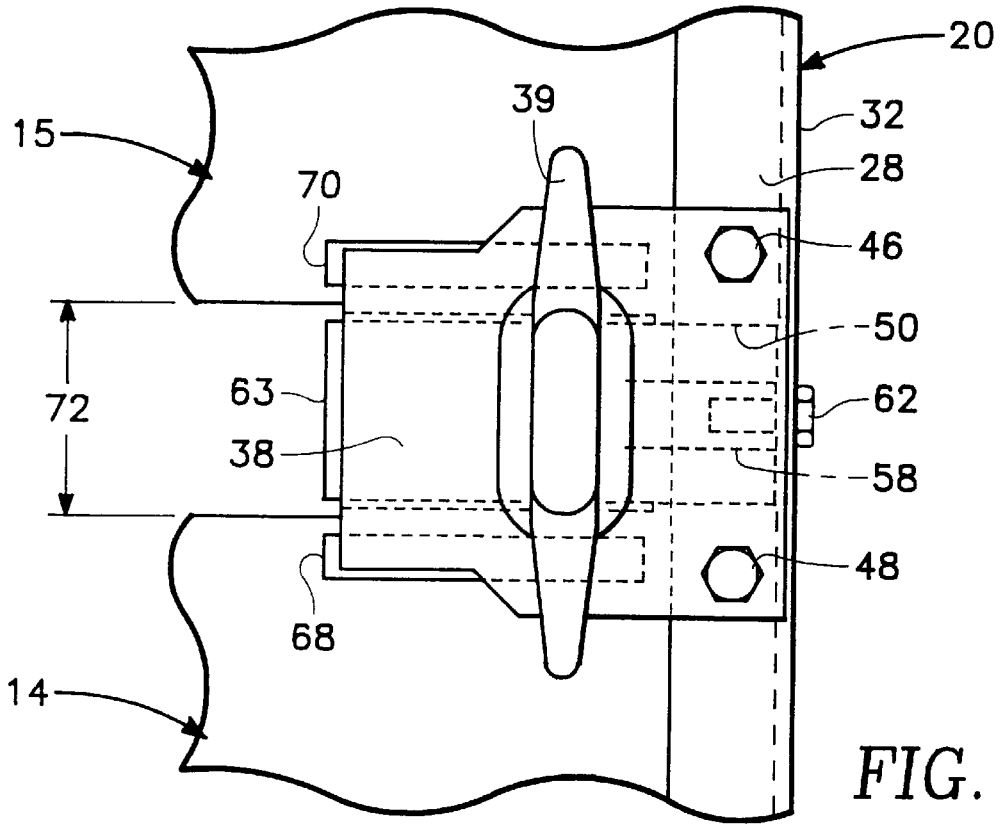
FIG. 2 is a top view illustrating the causeway mooring apparatus being used with the pair of pontoons of the causeway illustrated in FIG. 1.

Referring first to FIGS. 1 and 2, there is shown a causeway mooring apparatus 10 adapted for use with a causeway 12 having a plurality spaced apart pontoons 14 and 15, with pontoon 15 being illustrated in phantom in FIG. 1. Each pontoon 14 and 15 of causeway 12 is a hollow box like structure fabricated from 3/16 inch steel plate. Each corner of pontoon 14 and 15 has a rectangular shaped plate 16 which includes a threaded opening 18.

Causeway 12 also has a pair of L-shaped stringers 20 and 22 which are the structural elements for securing one pontoon 14 to adjacent pontoon 15 in the manner illustrated in FIG. 2. Stringer 20 has a pair of openings 24 and 26 on its top portion 28 and an opening 30 on its side portion 32. In a like manner, stringer 22 has an opening 34 on its side portion 36.

Figure 3:
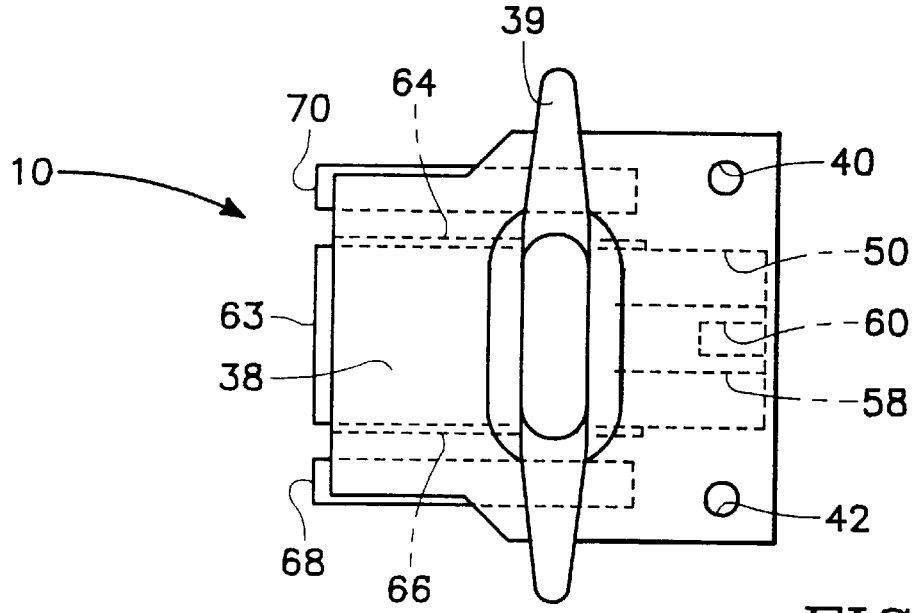
FIG. 3 is a top view of the causeway mooring apparatus illustrating its cleat mounting plate and the hull type cleat mounted thereon.

Causeway mooring apparatus 10 includes a cleat mounting plate 38 which has mounted on its top surface a hull type cleat 39. Openings 24 and 26 of stringer 20 respectively align with a pair of openings 40 and 42 (FIG. 3) within cleat mounting plate 38. Openings 24 and 40 align with the threaded opening 18 at the upper right corner of pontoon 15 to receive a threaded bolt 46 which secures stringer 20 and plate 38 of mooring apparatus 10 to pontoon 15 as well as causeway 12. In a like manner, openings 26 and 42 align with the threaded opening 18 at the upper left corner of pontoon 14 to receive a threaded bolt 48 which secures stringer 20 and plate 38 of mooring apparatus 10 to pontoon 14.

The hull type cleat 39 of mooring apparatus 10 is adapted to receive and secure to a causeway mooring and tow lines such as a four inch double braided nylon rope which have breaking strengths of approximately 59,000 pounds.

Figure 5:
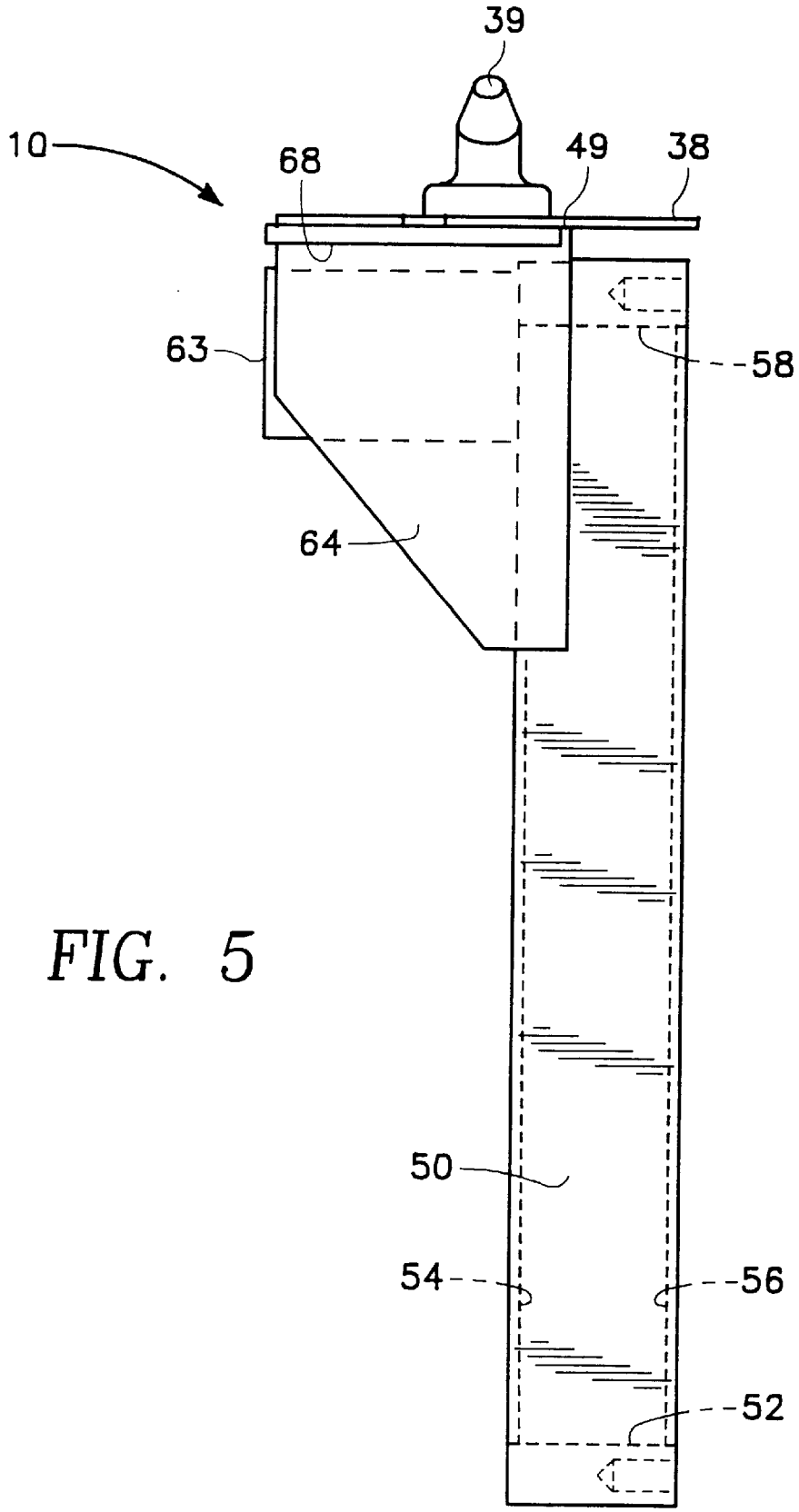
FIG. 5 is a side view of the causeway mooring apparatus of the present invention.
Figure 6:
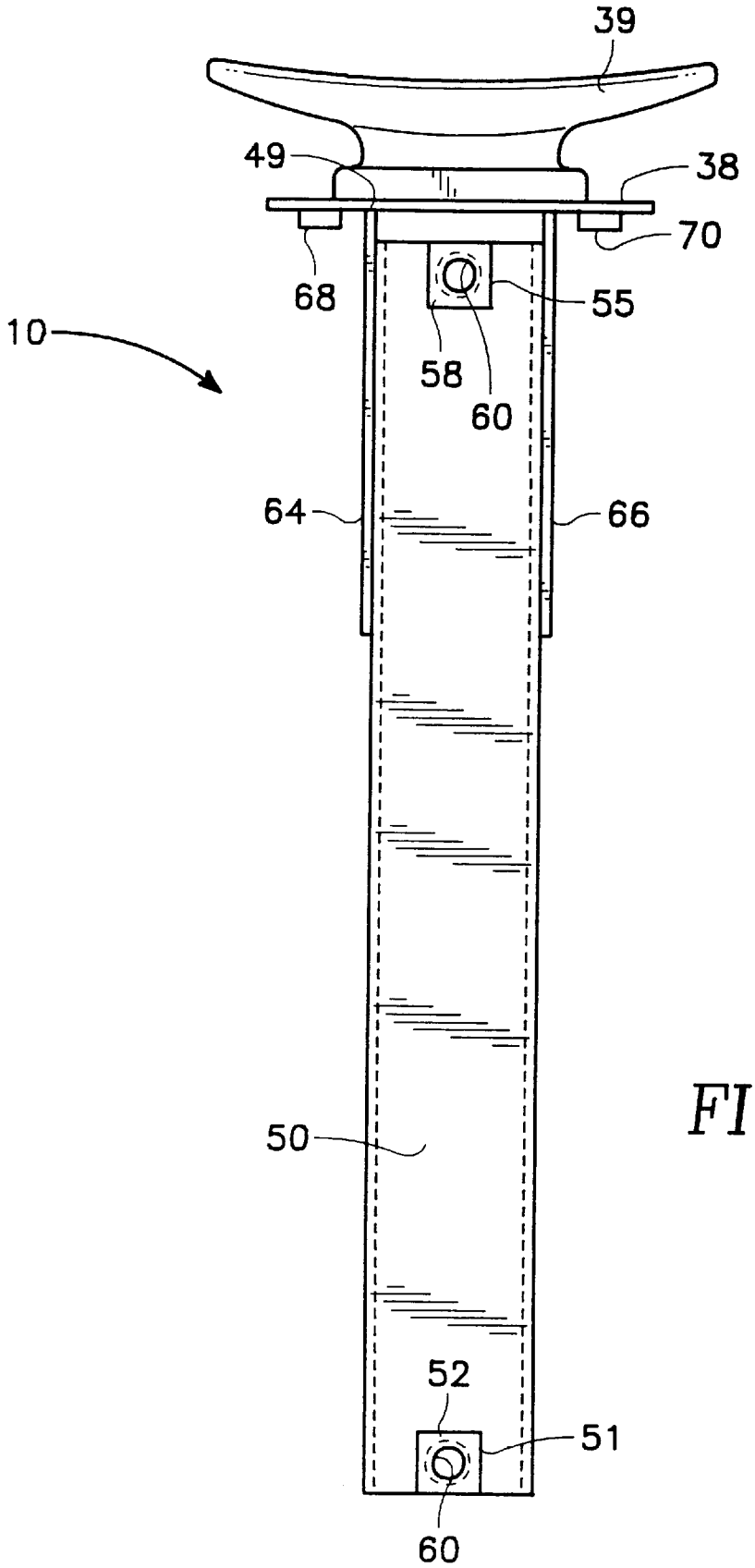
FIG. 6 is a rear view of the causeway mooring apparatus of the present invention.

Referring to FIGS. 1, 5 and 6, mooring apparatus 10 also has a tubular shaped support member 50 which extends vertically downward from the underside of cleat mounting plate 38 to the bottom of pontoon 14 as is best illustrated in FIG. 1. There is positioned at the bottom of member 50 a bolt support bar 52 which has one end thereof affixed to a rectangular shaped opening 51 within the front wall 54 of member 50 and its opposite end affixed to a rectangular shaped opening 53 within the rear wall 56 of member 50. There is also positioned at the top of member 50 a bolt support bar 58 which has one end thereof affixed to a rectangular shaped opening 55 within the front wall 54 of member 50 and its opposite end affixed to the a rectangular shaped opening 57 within the rear wall 56 of member 50.

Each bolt support bar 52 and 58 has a threaded opening 60. Threaded opening 60 of support bar 58 aligns with opening 30 of stringer 20 to receive a threaded bolt 62 which secures causeway mooring apparatus 10 to stringer 20.

Threaded opening 60 of support bar 52 aligns with opening 34 of stringer 22 to receive a threaded bolt 65 which secures causeway mooring apparatus 10 to stringer 22.

Figure 4:
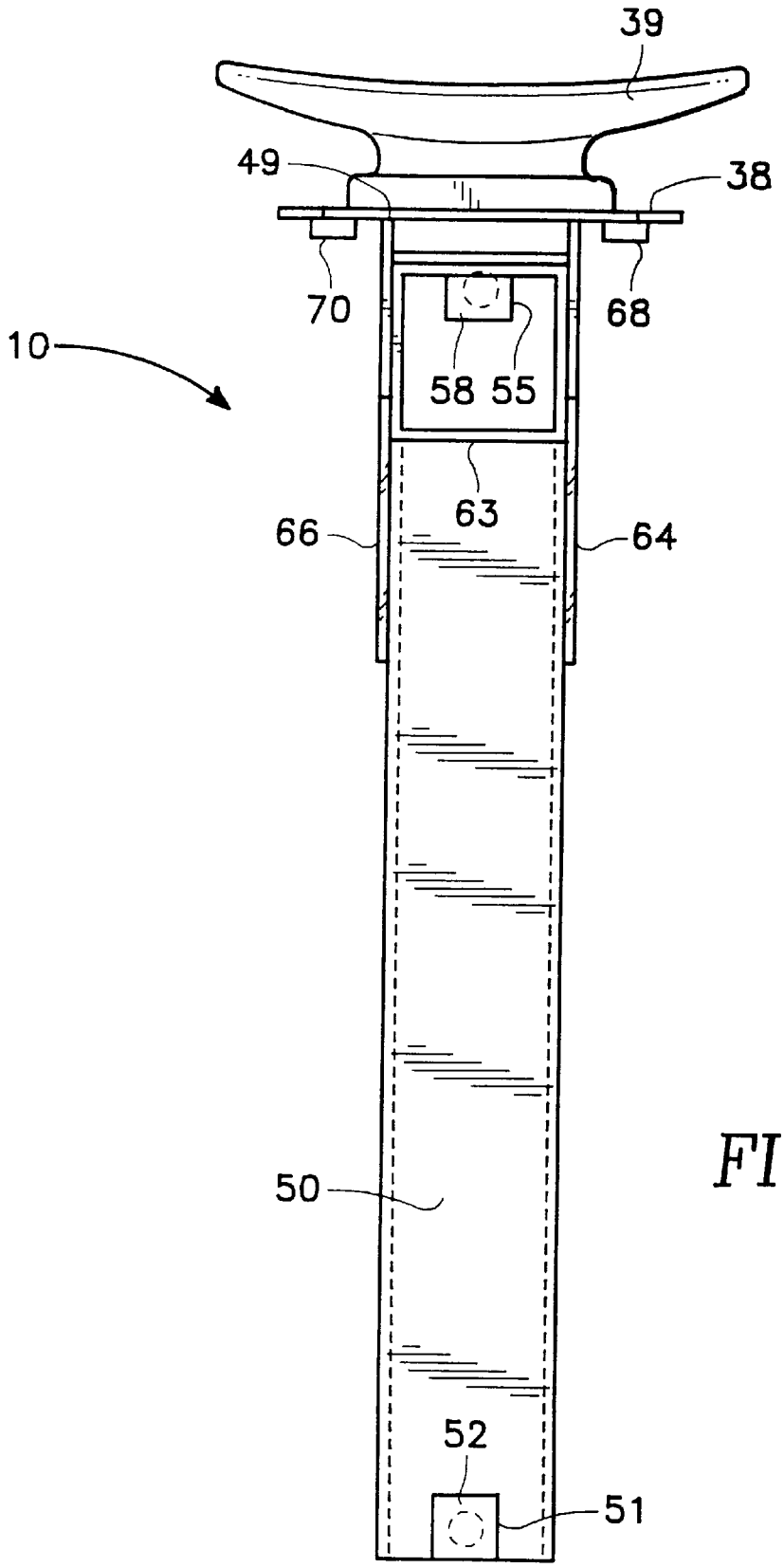
FIG. 4 is a front view of the causeway mooring apparatus of the present invention.

Referring now to FIGS. 1 and 4, causeway mooring apparatus 10 has at its upper portion a tubular shaped support member 63 which extends horizontally outward from support member 50 and is affixed to support member 50. Support members 50 and 63 form an L-shaped foundation for causeway mooring apparatus 10.

Attached to the right side of tubular shaped support members 50 and 62 is a side stiffener plate 64. There is also attached to the left side of tubular shaped support members 50 and 62 is a side stiffener plate 66. The bottom side of cleat mounting plate 38 is affixed to the top edge 49 of side stiffener plates 50 and 62 which provide support for cleat mounting plate 38 and hull type cleat 39.

Referring to FIGS. 1, 4, 5 and 6, mounted on the bottom side of cleat mounting plate 38 near each edge of plate 38 are a pair of support bars 68 and 70. Support bar 68 rest on the upper surface of pontoon 14, while support bar 70 rest on the upper surface of pontoon 15.

As shown in FIGS. 1 and 2, causeway mooring apparatus 10 fits within the gap 72 between adjacent pontoons 14 and 15 of causeway 12. Gap 72 is approximately 9⅛ inches wide.

The torsional capacity of causeway mooring apparatus 10 is in a range of 7 to 10 kips with the torsional capacity being dependent upon load conditions.

Causeway mooring apparatus 10 also has the ability to withstand mooring and towing loads of up to 200,000 pounds in a horizontal plane in any direction about hull type cleat 39. Mooring and towing loads up to 200,000 pounds will not cause permanent deformation to cleat 39 or causeway mooring apparatus 10. Side stiffener plates 64 and 66 distribute applied loads from hull type cleat 39 through tubular shaped support member 50 to the pair of L-shaped stringers 20 and 22.

Support members 50 and 63 were made from 8 inch×8 inch×0.5 inch structural steel tubing fabricated from ASTM 500 grade B steel. The length of support member 50 is 4 feet 11⅛ inches, while the length of support member 63 is one foot. Side stiffener plates 64 and 66 are ⅜ of an inch thick and have overall dimensions of 14 inches×1 foot-8 inches. Similarly, cleat mounting plate 38 is ½ inch thick and has overall dimensions of 18¼ inches×1 foot-8 inches. Side stiffener plates 64 and 66 and cleat mounting plate 38 are fabricated from A36 grade steel plate. Threaded bolts 46, 48, 62 and 65 are 1½"ϕ-6UNC×0'-3½", HEX HD, ASTM A325 threaded bolts.

It should be noted that welds are used to join the various elements of causeway mooring apparatus 10 and the welds conform to the Structural Welding Code, AWS D1.1. Cleat 39 is a 24 inch hull type cleat.

From the foregoing, it may readily be seen that the present invention comprises a new, unique and exceedingly causeway mooring apparatus for use in securing tow and mooring lines having loads up to 200,000 pounds which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A mooring apparatus for use with a causeway having a plurality of pontoons comprising:

first and second L-shaped stringers for connecting first and second adjacent pontoons of said causeway;

an L-shaped support frame adapted to be interposed within a gap located between said first and second adjacent pontoons of said causeway, said L-shaped support frame having first and second tubular support members, said first tubular support member being removably coupled to said first L-shaped stringer at one end thereof and said second L-shaped stringer at the opposite end thereof;

first and second side stiffener plates attached to said L-shaped support frame, said first and second side stiffener plates adapted to extend downward into said gap, each side stiffener plate of said first and second side stiffener plates having a top edge adapted to be located above said gap;

a rectangular shaped cleat mounting plate having a bottom surface attached to the top edge of said first and second side stiffener plates, said cleat mounting plate adapted to being removably coupled to said first and second adjacent pontoons of said causeway; and a cleat mounted on a top surface of said cleat mounting plate, said cleat being adapted to receive and secure a tow line having a load capacity of approximately 200,000 pounds to said causeway.

2. The mooring apparatus of claim 1 wherein the first and second tubular support members of said L-shaped support frame are fabricated from 8 inches×8 inches×0.5 inch structural steel tubing.

3. The mooring apparatus of claim 2 wherein said structural steel tubing comprises ASTM 500 grade B steel.

4. The mooring apparatus of claim 1 wherein said first and second side stiffener plates are fabricated from ⅜ inch thick A36 grade steel plate.

5. The mooring apparatus of claim 1 wherein said cleat mounting plate is fabricated from ½ inch thick A36 grade steel plate.

6. A mooring apparatus for use with a causeway having a plurality of pontoons comprising:

first and second L-shaped stringers for connecting first and second adjacent pontoons of said causeway;

an L-shaped support frame adapted to be interposed within a gap located between said first and second adjacent pontoons of said causeway, said L-shaped support frame having first and second tubular support members, said first tubular support member being removably coupled to said first L-shaped stringer at one end thereof and said second L-shaped stringer at the opposite end thereof;

first and second side stiffener plates attached to said L-shaped support frame, said first and second side stiffener plates adapted to extend downward into said gap, each side stiffener plate of said first and second side stiffener plates having a top edge adapted to being located above said gap;

a rectangular shaped cleat mounting plate having a bottom surface attached to the top edge of said first and second side stiffener plates, said cleat mounting plate adapted to being removably coupled to said first and second adjacent pontoons of said causeway;

first and second support bars affixed to the bottom surface of said cleat mounting plate, said first support bar adapted to rest on an upper surface of one of said first and second adjacent pontoons and said second support bar adapted to rest on an upper surface of the other of said first and second adjacent pontoons;

a cleat mounted on a top surface of said cleat mounting plate, said cleat being adapted to receive and secure a tow line having a load capacity of approximately 200,000 pounds to said causeway.

7. The mooring apparatus of claim 6 wherein the first and second tubular support members of said L-shaped support frame are fabricated from 8 inches×8 inches×0.5 inch structural steel tubing.

8. The mooring apparatus of claim 7 wherein said structural steel tubing comprises ASTM 500 grade B steel.

9. The mooring apparatus of claim 6 wherein said first and second side stiffener plates are fabricated from ⅜ inch thick A36 grade steel plate.

10. The mooring apparatus of claim 6 wherein said cleat mounting plate is fabricated from ½ inch thick A36 grade steel plate.

11. A mooring apparatus for use with a causeway having a plurality of pontoons comprising:

first and second L-shaped stringers for connecting first and second adjacent pontoons of said causeway;

an L-shaped support frame adapted to being interposed within a gap located between said first and second adjacent pontoons of said causeway, said L-shaped support frame having first and second tubular support members, said first tubular support member being removably coupled to said first L-shaped stringer at an upper end of said first tubular support member and said second L-shaped stringer at a lower end of said first tubular support member;

first and second bolt support bars, said first bolt support bar being positioned at the upper end of said first tubular support member, said first bolt support bar having a threaded opening aligned with an opening in said first L-shaped stringer to receive a first threaded bolt, said second bolt support bar being positioned at the lower end of said first tubular support member, said second support bar having a threaded opening aligned with an opening in said second L-shaped stringer to receive a second threaded bolt;

first and second side stiffener plates attached to said L-shaped support frame, said first and second side stiffener plates adapted to extend downward into said gap, each side stiffener plate of said first and second side stiffener plates having a top edge adapted to be located above said gap;

a rectangular shaped cleat mounting plate having a bottom surface attached to the top edge of said first and second Side stiffener plates, said cleat mounting plate adapted to being removably coupled to said first and second adjacent pontoons of said causeway;

first and second support bars affixed to the bottom surface of said cleat mounting plate, said first support bar adapted to rest on an upper surface of one of said first and second adjacent pontoons and said second support bar adapted to rest on an upper surface of the other of said first and second adjacent pontoons;

a cleat mounted on a top surface of said cleat mounting plate, said cleat being adapted to receive and secure a tow line having a load capacity of approximately 200,000 pounds to said causeway.

12. The mooring apparatus of claim 11 wherein the first and second tubular support members of said L-shaped support frame are fabricated from 8 inches×8 inches×0.5 inch structural steel tubing.

13. The mooring apparatus of claim 12 wherein said structural steel tubing comprises ASTM 500 grade B steel.

14. The mooring apparatus of claim 11 wherein said first and second side stiffener plates are fabricated from ⅜ inch thick A36 grade steel plate.

15. The mooring apparatus of claim 11 wherein said cleat mounting plate is fabricated from ½ inch thick A36 grade steel plate.

* * * * *